US005593185A

United States Patent [19]

Olson

[11] Patent Number: 5,593,185

[45] Date of Patent: Jan. 14, 1997

[54] SYSTEM FOR MACHINE READING/INDEX MARKING PUBLICATIONS

[76] Inventor: Craig W. Olson, 154 W. Main St., Fontana on Geneva Lake, Wis. 53125

[21] Appl. No.: 177,937

[22] Filed: Jan. 6, 1994

Related U.S. Application Data

[63] Continuation-in-part of Ser. No. 819,792, Jan. 13, 1992, abandoned, which is a continuation-in-part of Ser. No. 599,734, Oct. 19, 1990, Pat. No. 5,080,399.

[51] Int. Cl.[6] ..... B42D 15/00

[52] U.S. Cl. ..... 283/70

[58] Field of Search ..... 283/67, 70, 81, 283/117

[56] References Cited

U.S. PATENT DOCUMENTS

| | | | |
|---|---|---|---|
| 4,240,848 | 12/1980 | Barber | 156/64 |
| 4,329,191 | 5/1982 | Barber | 156/64 |
| 4,580,815 | 4/1986 | Barber | 283/81 |
| 5,080,399 | 1/1992 | Olson | 283/70 |

*Primary Examiner*—Willmon Fridie, Jr.

[57] ABSTRACT

A system/process for code-marking and/or machine entering/reading a system of assigned coded reference markers for the relocation, access and retrieval of publication vessels and the desired information upon demand for either paginated or non-paginated vessel types. The system/process consisting of reading/entering either pre-coded and/or machine coding at least one marker (10) for the system before, during or after the marker is adheringly applied to the pre-determined/determined publication vessel(s) (50). The coding may be generated by at least one of the main printer (46) and/or sub-printer on at least one selected face (11,12) of at least one marker, where various forms of machine readable information may distinguish one category of coded markers, individually coded markers or selected marker coded faces thereof from each other to at least one publication vessel for the system. Such machine coding maybe provided from the exterior and/or interior of each marker member, may be directly applied to the face of the desired marker or may be indirectly attached to the marker face or faces by the application of at least one adhering label (20) which carries such readable information thereon the surface. Each marker member having at least one machine readable field (25,26), identification field and/or information field on at least one face consisting of at least one machine readable element (30,30*a*). Machine reading selected faces of selected markers to relocate, retrieve and access certain publication vessels from storage position and/or specific information within the confines of the respective publication to which the corresponding marker represents thereto.

21 Claims, 2 Drawing Sheets

ABC DIGEST
JUN. '85 VOL. 15
MACHINE CODE READER
DATA INPUT
Sub-Printer
MAIN Printer

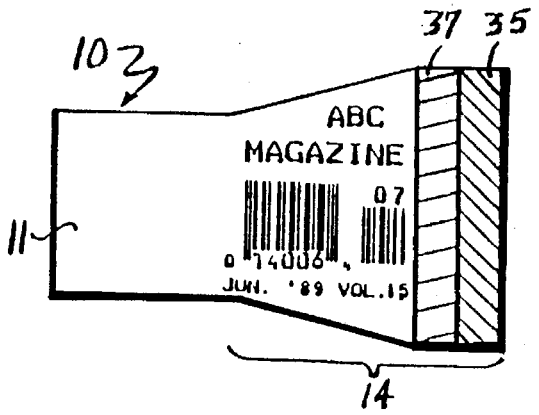
Fig. 4
Fig. 5
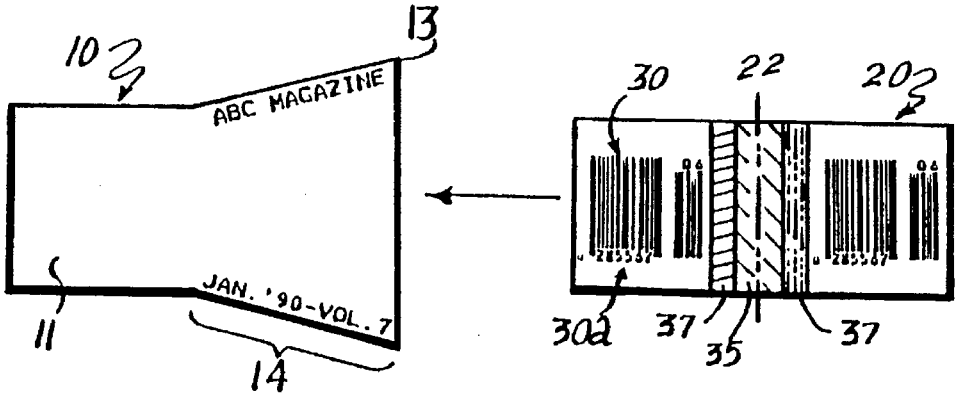
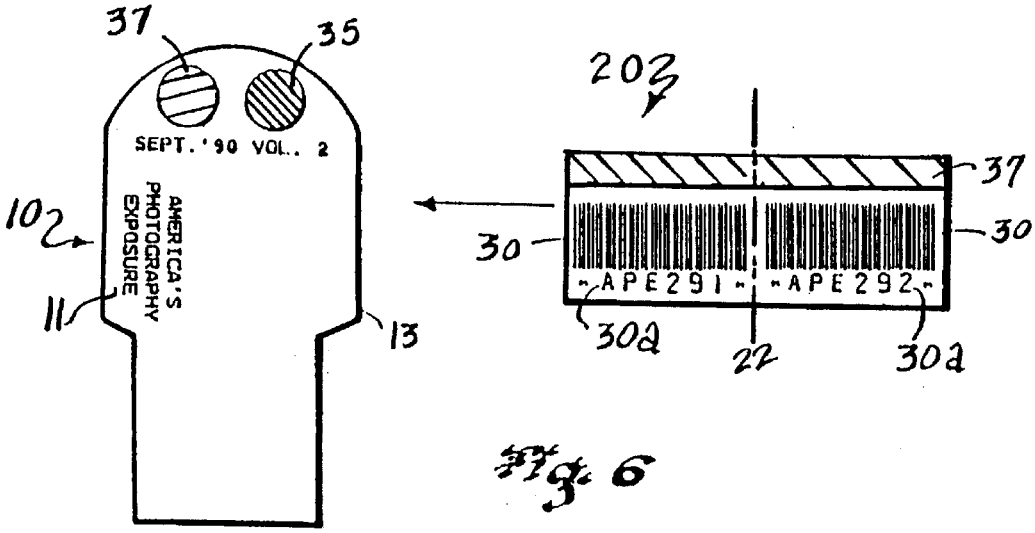
Fig. 6

SYSTEM FOR MACHINE READING/INDEX MARKING PUBLICATIONS

CROSS-REFERENCE TO RELATED APPLICATIONS

This application is a continuation-in-part of application Ser. No. 07/819,792, filed Jan. 13, 1992, abandoned, which is a continuation-in-part of application Ser. No. 07/599,734 now U.S. Pat. No. 5,080,399 issuing Jan. 14, 1992, filed Oct. 19, 1990.

FIELD OF THE INVENTION

This invention relates to a system/process for machine coding and/or reading a system of applied markers for a system of certain publication vessels and/or for obtaining specific information contained therein for vessel relocation, access and retrieval of the desired publication upon demand using machine-aided assistance; and, applying exterior coding to the marker's face or faces and/or inserting within the interior of the marker, self-generating device/code information and/or machine readable information therein. Optionally information coding label(s) applied to at least one marker's face being machine readable to represent selected/pre-selected publication information.

BACKGROUND OF THE INVENTION

In general, there are two methods to file paginated and non-paginated publications; both publication types are information-containing vessels which are found in the school, home or office and lend themselves to being utililzed as a personal library of current reference source material capable of being accessed at any given moment, but, however, with manual difficulty. One method is to insert publication vessels into their own file folder, then placing the file folders juxtaposed in file drawers. The other method is to individually place them juxtaposed in a storage receptacle which may be a floor container or shelf file system.

Although both aforesaid filing methods have been found acceptable practice for the home, office and institution use, limitations exist when attempting to re-locate, retrieve and access or inventory voluminous publication vessels stored collectively in file. Typically the publication's binding type has determined the groupings of filed publication vessels. For instance, perfect bound periodicals are stored with their binding facing outward toward the asile whereby information is found and readable along the elongated backbone spine. Conversely, saddle-stitched mechanical design bindings do not offer nor provide such a planar area feature to allow the printing of such information. In the later case, the user is required to randomly pull each issue from its place in file, each from its juxtaposed position to read pertinent issue information located on the outside front cover panel. Therefore, it is to be noted, that by mechanical design, the perfect bound (glued spine) and saddle-stitched spines are consequently incomparable when stored collectively in a desired storage receptacle environment. It is highly uncommon to find in many homes or offices, people that save particular reference source publication back issues, would separate and establish isolated filing procedures to distinguish one binding type from another, similar to what a library or institution might provide in the way of shelf or drawer file receptacles. Also, due to the variated sizes of non-paginated publication vessels such as, audio cassettes, video cassettes, computer floppy discs, compact discs and micro cassettes, inventory control, indexing, relocation and retrieval are similar problematic concerns for which the present invention resolves.

Further, should the employment of a file drawer method be used, the consumer is expected to purchase or obtain a file folder prior to the publication insertion therein; the file folder being the common vehicle to "create" compatability among both perfect bound and saddle-stitched publications which are generally of standard length and width dimensions categorically (typically less than the physical size of the receiving file folder itself). As for compact disc-containers, stamp and coin collection albums and other non-paginated publications they are/may be stored uniformily with the imprinted perfect binding spines which might be found on shelf files, facing the asile, as well. The ability to relocate and inventory either or both paginated and non-paginated publications vessels using adheringly applied index-markers bearing a variety of forms of information on the exterior and/or within the marker substrate or by self-attaching labels with machine readable information is key in this specification. This system/process permits rapid relocation, retrieval and access of certain desired publications upon demand.

In storage filing of publications having both perfect bound type or saddle-stitched bindings, there is a deficiency to distinguish one issue from another in such a mixed arrangement since there are no "end tabs" or "side tabs" which would provide such distinguishment when the publications are stored juxtaposed in file (without being inserted into a file folder jacket.) Commonly, saddle-stitched publications are positioned in storage with the fore-edge (the edge opposite the spine) facing the user thus protecting the publication cover from detachment during withdrawl and insertion. Yet, however, the problem of individual publication identification remains unaddressed. Regardless if such a collective mix of publications were filed with their unlike binding types exposed to the reader, the problem of relocating and easily inventorying the juxtaposed publications in storage still exists, when demand arises and therefore remains a manual, time-consuming task.

There are principal readable systems/types of machine readers to be used in the system of retrieving, re-locating and accessing publication information. These are by either or the combination of employment of "machine" readable elements by man, mechanical and/or electrical device being visually (scannable) readable graphics/characters of recognition such as numeric, alphabetic, alpha-numeric, color-coding and/or combinations thereof; and machine readable information which includes graphic recognition, character recognition, such as bar codes, alphbetic, numeric and alpha-numeric codes individually or in combination with each other. Also, other machine readers may read magnetic inks/characters, electro-conductive inks/characters, infrared/ultraviolet sensitive coding, marker's audible and/or inaudible signal coding, holographic coding, electronic generating/receiving signal coding including a variety of olfactory reading equipment (i.e. smoke detectors, fragrance, gas testing/sensing equipment).

Computers, having memory storage capabilities, are utilized to assist the re-location, retrieval, access and/or inventory control of the certain publication(s) information desired upon demand and its/their physical whereabouts such as floppy discs, cassettes etc. which are tracked and searched in computer memory. This system/process to re-locate and retrieve one or more desired publications may be accomplished by using one or more types of machine readers as aforestated, even perhaps by laser readers/scanner code entry, key board coding entry or any other type of suitable code reader herein described to enter such file information into the computer for later recall. It can be also noted, that data marker entry may be capable of cross-reference data link to source certain publications in file by one or more of the following methods; using reference characters, graphic coding, color-coding, electro-conductive substrate(s), electrical generation/pulse coding generation, olfactory sensory method coding, infra-red/ultraviolet coding, magnetic coding and mechanical coding. Each capable of source linking individually or cooperatively as desired, for computer interaction in the process of relocating, retrieving and accessing certain publication(s) and/or specific publication information upon demand.

Other manual systems are found to tremendously laborious, time-consuming and less efficient for the researcher requiring the desired information, especially when "mixed" publication types are stored collectively in a file receptacle or multitude of receptacles over a period of months or years. This lack of time and inability to relocate and retrieve the needed and desired information upon demand may truly discourage the researcher and the information "hunt" which may well prove to be a worthless attempt ending the task. Therefore, with the present retrieval system/process for paginated or non-paginated publications, such publications are less likely to be discarded early before its useful life has been exhausted.

Typically paginated publications such as periodicals, books, discs, etc. include a table of contents, generally, or perhaps an index listing of subject matter, such as advertisers or feature a roster of page numbers of "featured" articles contained within the issue. It is unique to utilize with or find included with a publication machine readable indexing/reference markers for retrieving and relocating filed publications in storage. Machine reading the markers for the system may be randomly performed or selected in a series for the publications in file to provide rapid re-location, inventory control and immediate access of the desired publication as needed by the user, as applicant describes in now issued U.S. Pat. No. 5,080,399.

Canadian Patent 925,764 shows a label for a file fold folder flap. The label is shown to be one-sided and printed information thereon, such as a name and two color-coded areas which are representative of the first two initials of the surname. However, no consideration is given in that patent to the machine reading of information set out on the label for individual index markers employing such machine read information by (a) regulating by identifying a publication through such machine reading step the input to generate, assign and/or direct the placement of index/reference markers being pre-determined, determined, post-determined for the certain publication, for example, may be a bordering surface area (margin); (b) controlling from such machine entering step, the generation of at least one machine readable field directly on marker member(s) or on at least one label for at least one marker's face; (c) controlling the input entering step, optionally, to generate, assign and/or direct the placement of custom-identified marker(s) and/or label(s) for marker(s) to post-determined/pre-determined position on certain publication(s).

U.S. Pat. No. 3,949,363 discloses various types of bar code, magnetic ink character recognition and optical character recognition printing used on cheques and the like. The particulars of the coded information may be read from the cheque; however, there is no discussion about using read information from one or more apparatus marker members (which may be separably removable from the parent publication) adheringly affixed thereto a respective publication in selected paginated series and/or to distinguish a categorical group of publications, and/or publication(s) individually of either paginated or non-paginated types for the system. The index/reference markers being read randomly and/or in series by such machine code reader or machine input entering to perform at least one of generating a marker/label, assigning a machine readable code to file-reference certain publication(s) and/or specific information contained within desired pages of the publication(s). The system/process engaged for the purpose of inventorying, maintenance and re-location and retrieval of certain publication(s) as desired to the system and/or specific information contained within such publication source(s).

The system/process, according to the present invention, overcomes a number of problems associated with publication re-location and retrieval of specific articles and the physical publications for the system by providing an index-marking and/or machine means readable system of coding the marker's exterior/interior substrate directly or indirectly coding the marker by means of at least one form. Also label(s) and/or markers may each be adheringly applied by at least one of at least one adhesive layer (pressure sensitive or dormantly activatible substrate), statically adhering attaching means, and magnetic attaching, non-adhesive marker engaged to the publication by a user. The engaged marker or markers to a publication vessel not only permits assigned identification to such publication vessel for filing purposes and later ease in re-location of the certain publication(s)/specific information contained therein, but also permits inventory control through machine reading information coding provided from the marker and/or from at least one face of at least one marker being multi-faced. In this reading of the index-marker's readable information, a computer may be programmed to generate and/or assign machine readable information coding of an array of varieties described herein, being produced in accordance with data input of the entered and/or read information permitting the application of at least one machine readable code field as assigned/pre-determined to at least one marker member for the system, before, during or after such indexing-markers are adhered to their determined/pre-determined position on at least one certain publication for the system. U.S. Pat. No. 4,204,639 discloses the use of additional labels applied to a file folder being of the color coded type to provide all the attendant advantages thereof. The same patentee, Barber, in U.S. Pat. No. 4,329,191 defines a process for labelling a system of file folders which comprises printing a set of indicia in a single field on one face of a pressure sensitive permanent label, where the indicia is both machine and visually readable and a mechanical labeller is programmable to control the application of labels to the same file folder by the input from such machin reading step in application of individual color coded labels to the file folder flap, where each color-code represents one label as applied, has indicium corresponding to one of the machine read indicia.

Further, Barber's U.S. Pat. No. 4,580,815 discloses a composite strip for the subsequent application of a discret series of labels applied to such composite strip before its application to the edge of the substrate; the composite strip advantageously used in combination with a tab extension to provide an add-on assembly. Barber shows limitations in the above cited disclosures mentioned which specifically define the application of labels, each with a single color-code, for alphabetically labelling specifically file folders, namely. However, there is no discussion about using a system/process for code-marking and/or machine reading a system of index/reference/game/coupon markers, in various combinations, for the relocation, access and retrieval of publication information upon demand of either paginated or non-paginated vessel types. The system/process consisting of reading coded/pre-coded markers and/or machine coding at least one marker member for the system, before, during or after the marker is adheringly applied to the predetermined/determined certain publication(s). The coding may be generated by the main printer and/or sub-printer on at least one selected marker and/or marker's face, where various forms of machine readable information may distinguish one category of coded markers, individually coded markers or selected marker coded faces thereof from each other to at least one publication vessel for the system. Such coding may be self-generating from the exterior and/or interior of each marker member, may be directly applied to the face of the desired marker or may be indirectly attached to the marker face or faces by the application of at least one adhering label which carries such readable information thereon/therewithin. Each marker member having at least one readable machine field on at least one face consisting of at least one machine readable element. Optionally, machine reading selected faces of selected markers to relocate, retrieve and access certain publication vessels from storage position and/or specific information within the confines of the respective publication to which the corresponding marker represents thereon for the purpose of inventory control maintenance, additionally. As this specification relates to publication vessels, it is to noted that file folders are excluded from the defined claims herein and from the target category of articles namely—paginated and non-paginated publication vessels. The present invention further provides and indexing system which is comparable to both shelf/drawer system and other file storage receptacles; by comparison, Barber, is only concerned with a labelling system for "shelf file folders" of which his patented specification is restricted thereto.

SUMMARY OF THE INVENTION

A system/process for code-marking and/or machine reading a system of at least one marker member for at least one publication vessel, comprising producing/generating at least one marker and/or label for the system. The label and/or marker carries on its face at least one machine readable code field having at least one machine readable element coding to represent and identify each labelled marker member and/or each directly coded marker substrate from other markers to the same publication vessel and/or to different publication vessel for the system. Reading and/or generating at least one field having at least one machine readable coding and/or optionally at least one corresponding visually readable coding for identifying selected faces or marker interior substrates as assigned to at least one certain publication in a category or individually and/or to specific contents within the publication(s). Optionally, generating/producing at least one label for at least one marker's face, such label having at least one machine readable field/area thereon. Individually adhering the desired generated/assigned label(s) to a marker and/or a individually adhering at least one to a certain publication and/or to specific contents within a publication vessel, where each respective publication to which at least one marker is assigned has at least one marker for the system. Such at least one generated/assigned machine readable marker being regulated by identification through such entering/assigning step, directing each marker to be applied to a certain publication for the system enabling the relocation and retrieval of such certain publication desired in which to access the information therefrom. The entering step being at least one of machine reading and/or machine entry (i.e. keyboard). At least one machine reader and/or at least one type of machine reader may be employed to enter marker/publication data for marker code reading and/or marker code assignment, as needed. The machine code/reader and corresponding machine readable coding may be at least one from the following group consisting of visible image readable coding information, invisibile readable coding information, magnetically readable information coding, holographic readable information coding, electronically readable signal/information coding, mechanically readable information coding, electro-conductive substrate readable coding, and olfactory sensory readable information coding. Wherein by at least one of before, during and after such marker member is adheringly applied to said publication vessel, machine reading and/or machine coding the exterior of a marker's face surface and/or the interior of the marker member substrate which may encapsulate/house circuitry, electro-conductive material, illuminating material or olfactory materials, as examples. Position of the selected/desired marker member placement to a certain publication may be determined pre-determined and/or post-determined. Regulating by identifying through such machine entering step the input/output directing at least one label to at least one marker and/or directing the printer/subprinter to produce/generate at least one machine readable field to code at least one machine readable marker/label and/or directing to a machine (directly or indirectly) the information coding to identify selected marker(s) and selected face(s) thereto. In some cases, markers/labels/may be pre-coded and issued with a publication vessel. Optionally, publication at least one form of publication machine reading information may be located on the spine backbone of a publication vessel, adjacent to the backbone, spaced from the backbone or in a saddle-stitched publication vessel either, adjacent the fold line and/or spaced from the fold line, thus allowing at least one machine readable code reader to receive the desired publication vessel information for retrieval, relocation and accessing computer-aided activities. Computer generated summary sheets may be used to list reference publication sources, if desired.

One object of the present invention provides a system for code-marking and/or machine reading a system of publication reference identification markers to relocate, retrieve and access publications by machine aided assistance for the system/process, comprising machine means for coding, labelling and/or reading at least one reference marker for at least one publication vessel for the system. Each of such reference marker means on at least one face means having at least one said readable information field consisting of at least one readable means information therefor. Machine means to input enter such readable information to storage for publication machine retrieval means and/or reading means to relocate and identify certain such at least one reference marker and selected such at least one code of said at least one marker to relocate at least one certain publication for the system and/or contents within the respective publication to which such at least one reference marker correspondingly represents thereon.

Another object of the present invention is wherein such at least one readable information field is optionally corresponding to at least one color-code represented with at least one machine code/field of the reference marker.

Still another object of the present invention is at least one machine readable reference marker information having at least one machine readable element taken from the group consisting of illumination coding, magnetic coding, electronic coding, electro-conductive substrate(s) coding, holographic coding, audible signal coding, inaudible signal coding, mechanical coding and olfactory coding, including scannable visible and/or invisible coding, readable infra-red coding.

Another object of the present invention in the system/process is at least one of before, during and after such reference markers are applied to the publication vessel, machine reading at least one machine readable field and/or at least one machine readable code; and, wherein at least one of before, during and after such reference markers are applied to the publication vessel, machine coding at least one reference marker for the certain publication vessel.

Still another object of the present invention is the system/process wherein machine readable coding is applied/secured to at least one reference marker exterior and/or interior of the reference marker before, during or after the reference marker is applied.

Yet another object of the present invention for the process/system is wherein by at least one of before, during and after such marker is adheringly applied to said publication vessel, applying the protective thin and generally flexible covering to at least one reference code/marker(s), wherein such reference marker is adheringly applied being taken from the group consisting of at least one of at least one adhesive layer, at least one magnetic substrate, and at least one statically adhering substrate, and friction adherence.

A further object of the present invention for the process system is wherein at least one reference marker machine code reader for the system is at least one of taken from the group consisting of at least one scanning visible reader, at least one scanning invisible reader, at least one infra-red reader, at least one holographic reader, at least one mechanical machine reader, at least one electronic reader, at least one magnetic reader, at least one electro-conductive substrate reader and at least one olfactory sensory reader.

Still yet another object of the present invention for the system process wherein at least one label having at least one machine readable code is generated/produced for at least one publication reference marker; wherein the label is read and/or generated by at least one of before, during and after the label is applied/secured to the publication reference marker.

Another object of the present invention, in a process/system for code-marking and/or means for reading a system of at least one machine readable reference marker assigned to at least one publication vessel comprising means for entering assigned code means information for the system, generating at least one informationally corresponding reference marker and/or at least one label for the reference marker for the system, such label and/or reference marker on at least one face thereof, carrying at least one machine readable information field to categorically similarly represent and/or differentiate at least one reference marker/marker label for the system, machine reading said at least one information field on at least one label and/or at least one marker's face before, during or after adheringly applying the reference marker/label to the publication vessel and/or before, during or after applying the least one label to the marker's substrate surface.

Still another object of the present invention is a system/process wherein at least one reference marker substrate and/or at least one label is coded/identifyable by at least one of the main printer and/or sub-printer which may actuated by an in-line switch.

A process/system for assigning reference code markers for a system of publications, paginated and/or non-paginated types, to retrieve, re-locate and access desired certain publications from placement in file comprises coding, for machine reading purposes, reference marker substrate(s) and/or labels for the reference marker(s) adhering application thereto; such at least one label providing a means to indirectly apply at least one machine readable code to the marker substrate. Each marker member may also carry at least one sub-field as an option. Each primary, secondary, tertiary, etc. sub-field carries at least one machine readable code. The sub-fields may also carry at least one pair of readable elements, wherein such pair of elements may be mutually corresponding to each other and/or to a categorical group of reference marker elements to differentiate categories from themselves, reference markers from themselves, and marker substrate faces from each other if desired. Machine readable reference markers may be differentiated from-other publications or for the same publication, depending upon the assignment of at least one machine readable code information to each reference marker being peculiar to and representative of one marker, a group of categorical markers and/or at least one face of a marker. Marker information coding may well include individual machine readable coding or perhaps a pair or multi-groups of various machine readable coding including visually readable character(s)/coding element(s) and/or any other desired means to code; the at least one machine readable code having at least one of a determined, pre-determined and post-determined relationship to machine readable coding on other reference markers and/or to publication vessel coding and/or to faces of the same marker. The placement and code position on a marker may be readable on the interior/exterior thereof and a selected or pre-selected marker having at least one machine readable information field may extend beyond the physical edge of the publication, if desired. In the same or different system/process operation, coding at least one field (primary and/or subordinate) and orienting the field(s) to accommodate machine readable information for example, (olfactory scent(s)/gas(es)) coding, electro-conductive substrate(s)/components, etc. to name just a few molecular-interchange/agitation possibilities), on at least one reference marker field area of at least one surface of the multi-faced marker.

Before, during or after adheringly engaging a reference marker to a vessel margin (shown) or publication substrate surface (not shown), optionally applying at least one label to at least one surface of such marker/marker area to be employed. An extending label may be folded about imaginary fold lines, as desired, for example, folded length wise, width wise or otherwise) so as to isolate at least one machine readable code field, color-code, and/or visually readable code. This code information may be positioned as desired, such as head-to-head, head-to-foot, foot-to-foot to cite a sampling of code positioning opposite the foldable line(s), visual or imaginary, to the label. A duplicate and/or different at least one machine readable code field is machine/manually applied to appear on at least one face/publication substrate for the reference marker to which a label may be applied with or without visually readable code information. At least one of before, during, or after adheringly applying each reference marker code to the publication vessel desired area, machine entering one or more field information coding to register the assigned marker in the computer corresponding to the certain publication vessel and/or specific contents, for which it represents.

The primary field, having at least one field may optionally, be assigned/read to identify a certain publication or perhaps a group, categorically, of publications. Further, should any sub-field(s) be employed, they may be utilized to identify a series of particular reference marker(s) to a certain publication and/or particular reference marker faces/indicia corresponding by associative relationship to the publication vessel and/or to each other. A master color-coding system may be used to correspond to and/or identify certain publications to a category and/or groups of reference markers to the same or different publications (i.e. similar topic information-robotics). As master color-codes may be used to also identify primary machine readable fields, sub-fields may be identified by subordinate color-coding. The sequence of color arrangement is discretionary and at the will of employer. This system/process to relocate, retrieve and access publications for the system in a simple economic manner using machine-aided assistance may utilize the application of the randomly placed, staggered, consecutive or otherwise arrangements of the indexing-reference marker's themselves to at least one publication vessel. Moreover, when one or more publication vessel(s) using the same system of machine readable reference marking, are stored juxtaposed in a file receptacle, the present invention eliminates the need to physically remove each and every publication from position in file for review during the relocation, retrieval system/process.

Therefore, the entered publication vessel to the system in file or to be filed within the system, may have one one more machine readable reference markers applied thereto; the reference markers having at least one machine readable information coding identifying the certain publication vessel and/or specific information contained therewith for paginated magazines, periodicals, reference sources, etc. as well as non-paginated reference vessels such as compact discs, floppy discs, video cassettes, audio cassettes and other types and forms of publication vessels like coin, stamp, photo albums. Each machine readable element within at least one information field may be variated, if desired from an assortment of machine readable coding, i.e., bar-codes, magnetic susbstrate (like ink), electro-conductive substrates/components, chemical substrates, alphabetic, numeric, alpha-numeric coding, etc. The machine readable coding is assigned to represent and identify a certain publication and/or categorical group of publication vessels. For instance, the reference marker may carry the publication's volume number, issue date indicating the certain publication vessel, being in some form of machine readable coding. This will allow machine relocation, retrieval and access assistance in locating the physical publication vessel whereabouts, including for inventory control for check-in and check-out functions from publication storage in file, be it shelf files, drawer file receptacles or otherwise. Master and/or subordinate color-coding may be employed to assist the machine readable primary and secondary fields respectively used in a cooperating manner. Hence, this provides the publication vessel with machine/visually recognizable coding for retrieval purposes in file.

BRIEF DESCRIPTION OF THE DRAWINGS

FIG. 4 is an elevational plan view of another embodiment of the marker shown in FIG. 1 illustrating the incorporation of optional color-coding thereon corresponding to at least one machine readable field/code thereon.

FIG. 5 is a plan view of another embodiment of a marker with a label prior to being applied according to the invention; and, FIG. 6 is a view of another embodiment of a fold-over label for the system illustrating a label applied in another manner.

Figures 1, 2, 3:
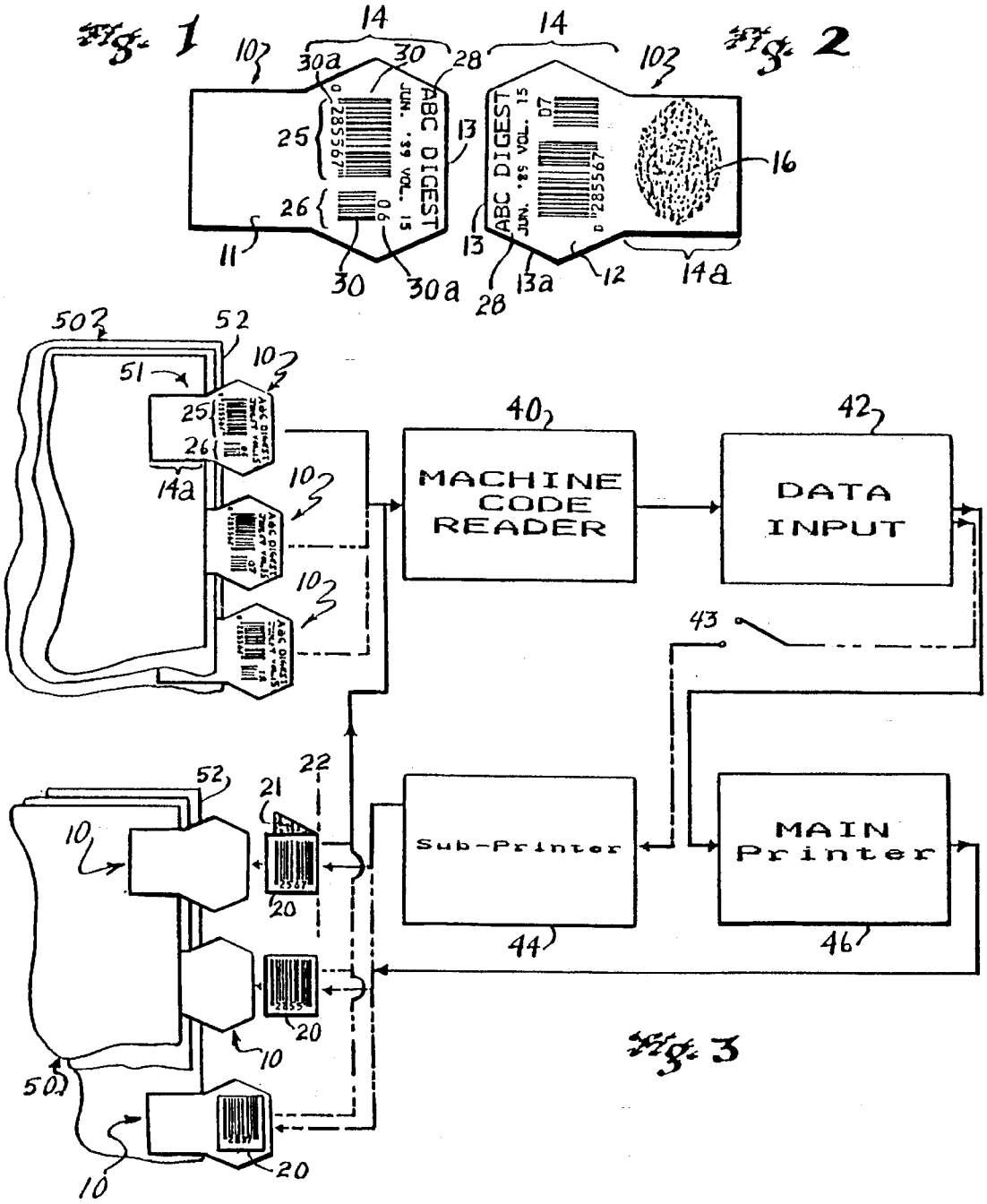
FIG. 1 is an elevational plan view of an apparatus marker for the system as a preferred embodiment in accordance with the present invention.
FIG. 2 is an elevational plan view of the apparatus marker shown in FIG. 1 showing the reverse side thereof.
FIG. 3 is a block diagram of the components of the system for machine readings, reference/index marking publication information-containing vessels according to a preferred embodiment of the present invention showing fragmented publication vessels which have application of the coded marker members illustrated in arrangement thereon and employing at least one of the main printer and/or sub-printer for the process/system in the alternative.

The drawings have been elected to show an example of bar-coding and color-coding in an illustrative fashion, however a variety of other machine readable coding such as illumination, olfactory coding etc. as described herein (not shown) may be employed in application.

DETAILED DESCRIPTION OF THE PREFERRED EMBODIMENTS

FIG. 1 illustrates an apparatus reference marker 10 for the system, showing one side of the multifaced marker substrate machine/coded with machine readable information on the surface thereof in accordance with one of the preferred embodiments of the present invention. The reference marker 10 has a portion 14 or its head which is designed to extend beyond the edge of its respective publication; the stem portion **14*a* and head 14** each being configuated in predetermined/determined/post-determined shapes of generally geometrical, generally modified-geometrical and irregular.

As can be seen, at least one adhering marker side (shown) has a portion 14 of its face 11 where the fields are preferrably located, only as an example; at least one machine field consisting of at least one primary field 25, and/or at least one sub-field 26 and optional identification field 28, as indicated by their respective numerals. Each of the primary field and sub-fields employed having at least one machine readable coding 30, **30*a* with optional visually readable coding. Although both elements to such may be machine readable, one element 30*a* is shown to be visually readable in association to its cooperating machine readable element 30. Shown adjacent to and spaced from, in this example, at least one reference marker's edge 13 of head portion 14, in FIGS. 1 and 2, is the identification field 28 illustrating placement as desired of visually readable information such as the publication's name (ABC DIGEST); issue date (June, 1989) and volume number (Vol. 15) in this example. Though shown to be positioned above the primary field and sub-field, in this alternative, the identification field 28 may be a single field or multi-field on each surface of the reference marker as an option, as desired, in a determined/pre-determined arrangement with the at least one machine readable field 25, 26. It is to be noted, that optionally, the at least one machine readable field and/or identification field may be a common field, semi-common (partial) field and separate field from each other. In FIG. 2, it is shown that at least one engaging area 16 backs up the other face surface 11 of the reference marker 10, The information fields 25, 26 and 28 being in identical arrangement in this example as head-to-head. In viewing together, FIGS. 1 and 2, it is to be seen that the primary field(s) 25, may be carried on at least one face of the reference marker and that also at least one sub-field 26** may be on at least one face, as an option. The sub-field(s) being utilized for sub-classification identification i.e., topic groups, publication categories, etc. Just as the primary field(s) may vary per publication vessel, so can the sub-field(s) vary on each reference marker surface, if desired, for instance to differentiate and distinguish one page of a publication vessel from another. It maybe that at least one information machine readable field may serve to identify different item(s) e.g., front and back faces of a page, if desired. It is further illustrated in this example, that the primary field(s) 25 and sub-field(s) 26 may be positioned, for instance, in the same latitude for convenience of continuous straight line scanning format, end-to-end. Some other relative field example positioning may be head-to-foot; end-to-head, end-to-foot or randomly placed as needed in arrangement on the surface of the reference marker. Each marker 10 may have field information peculiar to itself or to its faces, and/or to its publication vessel group of information. The information field(s) for machine reading purposes, may cover up to the entire surface of the reference marker substrate as needed. FIGS. 1 and 2 show the information field(s) as may extend the width of the marker, by example. As further shown in this example, primary field 25 and secondary sub-field(s) 26 are occupied by pairs of corresponding coding elements 30, 30*a*; the primary field(s) to generally identify the certain publication vessel and/or group of publication vessels to which it was assigned/pre-assigned/post-assigned. And, the at least one optional sub-field 26 may specifically identify specific pages of text subject matter within a paginated publication by the assignment of machine readable coding for computer-aided machine relocation and retrieval purposes. The machine readable coding may be at least one type of readable information such as, bar coding, magnetic coding, olfactory coding, chemical coding, mechanical coding, electro-conductive substrate/coding, electrical coding (circuitry), illumination, visible/invisible coding and the like. More than one machine reader may be employed at the same time and/or within the same and/or different computer systems.

Master color coding 35 may be additionally applied to a reference marker face(s) or group of marker to the same publication and/or different publication within a series/collection, denoting their grouping. Subordinate color coding 37 may be further used to differentiate one marker or markers surfaces from each other having the same end/or different master color coding. In the alternative, color coding may be used to correspond to one or more machine readable fields/machine readable coding. The shape of the reference marker 10 may take any concievable configuration as desired.

The fields 25, 26 and 28 may have one or more rows or columns in format design, for instance, in arrangement on the reference marker. The machine readable coding found on the marker's face or faces 11, 12 may be at least one of different, common and semi-common (partial) to such face(s). The system/process is designed to machine enter/read, record to storage the assignment of machine readable coding to publication vessels for the system, and retrieve/relocate such desired publication vessels using 42 computer aided assistance by machine reading coded publication reference marker(s). In function, reading/machine entering device/apparatus 40 to send publication coding to the computer 42 for logging assignment purposes and/or data input registration originally and/or relocation/retrieval information to source the physical location of the desired publication vessel(s). It is the combination of the machine readable reference marker code assigned, the machine code reader 40, the computer memory/storage system 42, and main printer 46 and/or sub-printer 44 which activates the publication retrieval/relocation system for filed vessels, and, perhaps those "misfiled" publications in file. Should a publication not have one or more assigned coding, the printer 46 and/or sub-printer 44 can produce/generate either a marker and/or label 20 for the publication, following manual or computer assignment of the code for the filing system, shown in FIG. 3.

In the alternative, the computer, may also issue the parameters determining marker location placement to the publication vessel 50. FIG. 3 illustrates the system/process with adherence of reference markers to the publication vessel 50 and the generation of labels to markers and/or alternately for publication directly.

In one version, the reference markers 10 are shown to have a stem portion 14*a*, however this is an option. For example, the reference marker may be a fold—over machine coded generated label, for folding over on a designated or imaginary line; the label then being attached to a page edge, publication cover, protective sleeve and the like. The marker, whichever form is elected, may have an optional reserved portion for hand-written notations. A thin, flexible covering substrate, sheet or liquid substance may be applied over the marker entirely or partially to provide protection and preservation (not shown). This protective covering substrate may be a vehicle to also carry machine readable coding as well, e.g. olfactory coding, color coding and otherwise.

It is also possible in view of the block diagram that the publication relocation, retrieval system of publications which uses the machine entered input data, designated by block 42, may direct a display monitor, the printer(s) 44, 46 to generate/produce a summary report/roster printout of such things as checked-out publications, publication groups by subject, inventory control, etc. as demanded for the search of certain publication vessels. Should one or more machine code readers being utilized for relocating and retieving the publication vessel(s), they may be connected to computer/memory data storage center 42 to serial/parallel port. Further the main printer 46 and sub-printer 44 may also be connected to at least one serial/parallel port. FIG. 3 shows the line connecting the sub-printer to have a switch 43 permitting on/off capability of this device, thus enabling the main printer to operate individually for the system. Whichever printer is utilized, the marker(s) and/or label(s) for the system may be produced individually or in multiples. Each machine coded marker/label may display the same, substantially the same, and/or different machine readable coding as temporary or permanent information to such marker/label.

Other examples of marker's faces shown in FIGS. 4, 5 and 6 illustrate other arrangements of identification fields 25, 26, 28 that occupy individual, commonly or semi-commonly (partially) the marker's/label's surface 11, 12. This publication vessel coding allows each publication to be identified in storage file thereby eliminating the laborious physical handling task to find desired information, upon demand.

FIG. 4 illustrates a reference marker utilizing the combination of color coding corresponding to machine readable fields present on the face of the marker. FIG. 5 shows, an alternative approach whereby the identification field is present on the marker and the label is machine coded with at least one machine readable field and carries color coding corresponding thereto. By comparison, FIG. 6 has identification field(s) exemplifying the presence of two subordinate color codes to have union with the generate label which carries the machine readable field(s) and color coding such as the primary categorical color, representing the publication vessel. In this example, the at least one primary code 35 and at least one subordinate code 37 may work independently and/or in union with each other and with the at least one machine readable field. Accordingly, color coding aids to assist in determining the category and/or file sequence of publication vessels/information. The marker code field(s) may appear on the exterior substrate of of the reference marker or be implanted partially or entirely with the reference marker substrate. In addition, the reference marker may be coated/encapsulated with a liquid substance to protect the reference marker durability. Film sheet material may optionally be used e.g. acetate, polyester and a host of other polymer/composite substances suitable for its intended use. The preferred substance is a flexible/semi-flexible substance and may also be semi-rigid or perhaps rigid, if desired. The marker 10 may also be attached to the publication vessel by means of a protective over-wrap jacket with protruding integrally formed tab or multi-tabs (not shown); these reference marker tabs may carry at least one machine readable field having at least one machine readable code. The protective over-wrap jacket may entirely or partially envelope the publication vessel as an alternative means of adhering the marker to the vessel. Further, a reference marker carrying at least one machine readable field and at least one machine readable code may be inserted and held by the interior portion of the publication vessel, e.g. friction hold, if desired. Label(s) may alternately be used in application to attach the machine readable field(s) to the reference marker, such as herein indicated may be folded over to wrap over the marker's substrate along imaginary line(s) and/or visible foldable line(s) 22. As before, the label may be protected by a coating substance, liquid or sheet. The liquid may encapsulate the marker and/or the label thereto or be applied in spot areas of the label and/or marker, as needed, before, during or after the marker and/or label is applied. It is to be noted, that a reference label marker may be directly or indirectly adhered to a publication vessel at least once on the exterior or interior thereof. FIGS. 5 and 6 also show in this embodiment of the invention, at least one adhering means label having at least one imaginary fold line 22 to partially over-wrap the marker 10. Yet in FIG. 3 a single label is shown for application to one substrate surface, therefore, other label(s) may be required for the same or different marker. Each label may carry not only at least one machine readable information field, but may additionally carry at least one identification field of information, e.g. visual characters, and/or information field, e.g. perfune coding, electro-conductive ink/substrate, etc. Such field(s) may be determined/pre-determined/post-determined to be upright in relationship to the filed publication vessel in storage. Otherwise the same may be said for alternately positioned field(s), as desired. However, machine code reading of the marker, should be taken into account when positioning the machine readable field(s) to facilitate reading convenience and not necessarily in relationship to the marker's edge 13. Duplicate or different machine readable code information in whole or in part, may be found on a different face of the same marker or different markers' substrate. FIGS. 4, 5 and 6 illustrate other alternative embodiments in keeping the present invention which, by example, show layouts of machine readable code information 30 recognition corresponding to at least one visually readable coding recognition 30*a*. It is possible that other machine readable coding be also used on the marker 10, for marker differentiation and/or similarity in grouping as such. Further, machine readable field(s), identification field(s) and/or information field(s) may be at least one of the same common fields, partial fields and individual/separate field(s). The at least one primary field 25 may be used for categorically defined information such as a publication type, subject material of a certain kind, etc. And, the at least one sub-field 26 may define, for instance, a particular topic, specific location of information, etc. The system/process of the present invention provides for personal flexibility to assign machine readable coding depending upon choice and need. Depending upon the selected position of the machine readable coding upon the marker 10 is a determining factor as to the fields for machine reading as to be viewed from the publication vessel filed in storage. As shown in FIGS. 1, 5 and 6 markers 10 having at least one machine readable field such as any primary field 25 and any subordinate field 26 which may be of the same field or isolated fields or partially shared fields, if desired.

The field(s) may be generated by machinery equipment as the main printer 46, is shown in the block diagram FIG. 3. However, sub-printer(s) 44 may operate individually or in cooperation with each other and/or with the main printer(s) 46. Depending upon the type of sub-printer, it may be capable of producing machine readable coded labels/sheets with common, shared or isolated fields. Other types of printing equipment for producing labels markers or both may be used to generate machine readable code information such as electro-conductive substrate(s) like ink, light sensitive readable invisible substrate(s), bar-coding, like popular code 39, magnetic ink substrate, mechanical code information such as embossed characters/patterns, to suggest just a few. Should label(s) be used, they may singularly applied, folded over at least one imaginary and/or visible line means or in the alternative, be banded around the reference marker, if desired.

Sub-printers, such as the Seiko thermal printer, sold under the trademark of "Smart Labeller" by the Seiko Corporation of Calif. or perhaps the Avery label printer are examples of such apparatus. These sub-printers can generate custom one-at-a-time labels without the need to exit the computer's main function/program a user is working in. Depending upon the brand of subprinter, capabilities may vary, for instance the generation of labels with machine/visual characters that correspond to each other, numeric coding, alphanumeric coding, and the like. Additionally, the reference markers/labels may be pre-coded aside from using the main printer or subpritner, with a variety of printing technology or other suitable techniques/equipment to achieve the desired machine readable marker(s).

Turning to FIG. 3 in accordance with the preferred embodiment, assigning/pre-assigning/post-assigning at least one machine readable code to at least one marker, and/or at least one label; such assigning entered by machine reader(s) and/or manual keyboard entry to register such reference marker code data into the computer 42, and storing such marker information on hard drive and/or floppy discs, tape, etc.

By machine entering data from at least one machine readable field, primary and/or subordinate types, the computer aids the relocation and retrieval process to access the desired publication vessel. The computer may also generate a summary/listing printout and/or display the information on the monitor as needed by the user and directed by the software. This may provide another vehicle for traceable publication in recovery of the publication vessels for later reference. Hence, the employment of at least one readable information field having at least one machine readable code individually or in combination provides a high-tech approach system/process to code-mark, machine read and retrieve certain desired publication vessels on a user-demand basis in the art of relocating publication information as a reference source. Likewise, a respective publication vessel once removed from its position in file, is re-directed and re-routed to its original location in file by the machine readable field coding.

As discussed, the computer data input/memory 42 can store publication vessel information on a sub-listing directory beneath the main listing, if desired, pertaining to specific subject matter on a summary report having both general and specific publication vessel listings including, for example, the corresponding readable fields for cross-reference purposes to indicate the physical location whereabouts in file storage.

For purposes of inventory check-in and/or check-out control, instead of reading the elements to the information field visually, machine reading at least one field assigned to the publication vessel to inventory and track the certain publication in and out of file position in storage.

In summary, a system for index code-marking and/or machine reading a system of reference markers for publications, comprising machining at least one coding, labelling and/or reading at least one reference marker for at least one publication vessel face thereof for the system of said publication vessels, wherein such machine readable information identifies at least one reference marker within a reference marker group and/or distinguishes at least one reference marker group from another reference marker group to the same publication or other/different publications for the system. Each of said reference marker is designated for each publication vessel having at least one said machine readable information field consisting of at least one machine readable code information thereon. Using machine(s) to input enter/read said machine readable marker information to storage for publication machine-aided retrieval and/or reading to relocate and/or identify certain said at least one reference marker and selected at least one code on such at least one reference marker to relocate at least one certain publication for the system and/or contents within the respective publication to which such at least one marker correspondingly represents thereto.

Further, alternately, a system for code-marking and/or machine reading a system of reference/index markers for publications, comprising machine readable coding for at elast one label for at least one selected face of at least one reference marker for the system. Wherein machine readable information distinguishes at least one coded reference marker's face/field from another marker's face/field to the same and/or different publication vessels for the system. Each label of such reference marker on at least one face thereof having at least one said machine readable field consisting of at least one machine readable code therein. Using machine(s) input/out the machine readable information to and/or from storage for machine retrieval and/or reading to relocate and/or identify certain such at least one reference marker and selected such at least one face of said at elast one marker to relocate to relocate at least one certain publication vessel for the system and/or contents within the respective publication to which such at least one reference marker correspondingly represents thereto.

Additionally, a process for code-marking and/or manner for machine reading a system of at least one machine readable marker member assigned to at least one publication vessel, comprising (a) entering at least one machine readable code for at least one information field by machine reading/outputing to identify at least one reference marker to at least one publication vessel for the system; (b) generating/locating/relocating at least one informationally corresponding reference marker and/or at least one label for at least one publication vessel for the system, said label and/or reference marker's substrate carrying at least one machine readable information field to categorically similarly represent and/or differentiate said at least one reference marker from another reference marker to at least one publication vessel for the system; (c) reading by machine at least one information field on at least one said reference marker and/or at least one label by at least one of before, during or after adheringly engaging said at least one reference marker to at least one publication vessel and/or by at least one of before, during or after applying such at least one reference label to at least one reference marker and/or publication vessel(s).

Although several preferred embodiments of this invention have been highlighted and illustrated both in written and drawing form, it will be understood to all those skilled in the art that some departures and variations may be incorporated hereto this invention without obviating the spirit and/or the scope of the present invention and appended claims which follow.

Obviously, many modifications and variations of the present invention are possible in light of the teaching presented herein and it is to be understood that terminology used to convey the thought is intended to be in "words of description" rather than of limitation of language employed. It is therefore, to be understood that descriptive language, example illustrations and likewise are exemplary and are not in anyway limiting since the subject invention may be accomplished and practiced otherwise than as specifically described herein the specification without departure herefrom the spirit and scope.

In view of the variations which may become apparent from the present invention, the claimant seeks to include such modifications of thought in which the following claims that provide the exclusive right and privilege to the intellectual property brought to light herein as follows:

What is claimed herein to be secured by Letters Patent is:

1. A process for index code-marking and/or machine reading a system of index reference markers for publications, comprising machine means for information coding, and/or labelling and/or reading at least one index reference marker means for at least one publication vessel means thereof for the system of said publications, wherein such machine readable information means indentifies at least one index/reference marker means within a reference marker group and/or distinguishes at least one reference marker group from another reference marker group to the same and/or other publications for the system;

each of said reference marker means designated for each publication vessel means having at least one said machine readable information field consisting of at least one machine readable code information means thereon;

machine means to input enter/read said machine readable marker information to storage for publication machine-aided retrieval means and/or reading means to relocate and/or identify certain said at least one marker and selected said at least one code on said at least one reference marker means to relocate at least one certain publication for the system and/or contents within the respective publication to which such at least one marker correspondingly represents thereto.

2. The process of claim 1 wherein said at least one machine readable code means is optionally corresponding to at least one color-code represented on at least one field from the group consisting of at least one identification field means, at least one machine code field means and at least one information field means.

3. The process of claim 1 wherein said at least one machine readable marker means information is at least one element taken from the group consisting of scannable means coding, magnetic coding means, electronic means coding, electro-conductive means coding, visible/invisible means coding, holographic means coding, audible/inaudible signal coding means, mechanical coding means, infra-red coding means and olfactory means coding, wherein said at least one readable coding information is read by at least one of before, during and after such marker members are adheringly mounted to their certain publication and/or specific contents therein.

4. The process of claim 1 wherein by at least one of before, during and after such reference marker means is adheringly applied to said publication vessel means, applying machine coding means to at least one of the marker's exterior substrate, substrate interior, and protective film means.

5. The process of claim 1 wherein by at least one of before, during and after such reference marker means is adheringly applied to said publication vessel means, optionally applying the protective thin and generally flexible covering means to at least one marker member, wherein said reference marker means adheringly is taken from the group consisting or at least one of at least one adhesive layer means, at least one magnetic substrate means, at least one statically adhering substrate.

6. The process of claim 1 wherein said reference marker means readable information is taken from the group consisting of at least one of visible and/or invisible readable information means, invisible information readable means, magnetically readable information means, holographic readable information means, electronically readable information means, mechanical readable information means, infra-red information coding means, electro-conductive means readable information, audible/inaudible signal code information means and olfactory code information means, wherein at least one machine reader means for the system is at least one element taken from the group consisting of at least one scanning reader, at least one infra-red reader means, at least one holographic reader means, at least one mechanical machine reader means, at least one electronic reader means, at least one magnetic reader means, at least one electro-conductive substrate means reader, and at least one olfactory sensory reader means.

7. The process of claim 1 wherein said at least one machine reader means reads interior and/or exterior of at least one reference marker means, wherein optionally at least one label means applies machine readable information means thereto at least one reference marker means and/or publication vessel means.

8. A process for code marking and/or machine reading a system of reference/index markers for publications, comprising machine readable information means coding at least one label means for at least one selected face of at least one reference marker member for the system, wherein machine readable means coding information distinguishes at least one coded reference marker's face/field from another marker's face/field to the same and/or different publication vessels for the system;

each label of said reference marker means on at least one face thereof having at least one said machine readable field consisting of at least one machine readable code means information therein;

means to machine input/output said readable information to and/or from storage means for machine retrieval means and/or reading means to relocate and/or identify certain said at least one reference marker and selected said at least one face of said at least one marker to relocate at least one certain publication for the system and/or contents within the respective publication to which such at least one marker correspondingly represents thereon.

9. The process of claim 8 wherein said at least one machine readable code means is optionally corresponding to at least one color-code represented on at least one field from the group consisting of at least one identification field means, at least one machine code field means and at least one information field means.

10. The process of claim 8 wherein said at least one machine readable marker means information is at least one element taken from the group consisting of scannable means coding, magnetic coding means, electronic means coding, electro-conductive means coding, visible/invisible means coding, holographic means coding, audible/inaudible signal coding means, mechanical coding means, infra-red coding means and olfactory means coding, wherein said at least one readable coding information is read by at least one of before, during and after such marker members are adheringly mounted to their certain publication and/or specific contents therein.

11. The process of claim 8 wherein by at least one of before, during and after such reference marker means is adheringly applied to said publication vessel means, applying machine coding means to at least one of the marker's exterior substrate, substrate interior, and protective film means.

12. The process of claim 8 wherein by at least one of before, during and after such reference marker means is adheringly applied to said publication vessel means, optionally applying the protective thin and generally flexible covering means to at least one marker member, wherein an adhering reference marker means is taken from the group consisting or at least one of at least one adhesive layer means, at least one magnetic substrate means, at least one statically adhering substrate and machine applied/labelled reference marker means.

13. The process of claim 8 wherein said reference marker means readable information is taken from the group consisting of at least one of visible and/or invisible readable information means, invisible information readable means, magnetically readable information means, holographic readable information means, electronically readable information means, mechanical readable information means, infra-red information coding means, electro-conductive means readable information, audible/inaudible signal code information means and olfactory code information means, wherein at least one machine reader means for the system is at least one element taken from the group consisting of at least one scanning reader, at least one infra-red reader means, at least one holographic reader means, at least one mechanical machine reader means, at least one electronic reader means, at least one magnetic reader means, at least one electro-conductive substrate means reader, and at least one olfactory sensory reader means.

14. The process of claim 8 wherein said at least one machine reader means reads from the interior and/or exterior of at least one reference marker means, wherein optionally at least one label means applies machine readable information means thereto at least one reference marker means and/or publication vessel means.

15. The process of claim 8 wherein said at least one reference marker means has information optionally embodied as a part of the marker's at least one face, and/or the interior of the marker's substrate.

16. A process for code-marking and/or means for machine reading a system of at least one machine readable marker member assigned to at least one publication vessel means, comprising:

entering at least one machine readable code for at least one information field means by machine means to identify at least one reference marker means to at least one publication vessel for the system;

generating/locating at least one informationally corresponding reference marker means and/or at least one label means for at least one publication vessel for the system, said label and/or reference marker's substrate carrying at least one machine readable information field to categorically similarly represent and/or differentiate said at least one reference marker means from another reference marker means to at least one publication vessel means for the system;

reading by machine said at least one information field means on at least one said reference marker means and/or at least one label means by at least one of before, during or after adheringly mounting said at least one reference marker means to at least one publication vessel and/or by at least one of before, during or after applying said at least one label to at least one reference marker means and/or publication vessel means.

17. The process of claim 16 wherein said at least one readable means information field is optionally corresponding to at least one color-code represented with at least one reference marker means, wherein said at least one machine readable code information means is readable from at least one of at least one face of at least one reference marker means, the interior and/or exterior of the reference marker means and at least one label having at least one machine readable code means for at least one reference marker means and/or publication vessel means.

18. The process of claim 16 wherein said at least one marker readable means information is at least one element taken from the group consisting of at least one scannable means coding, at least one magnetic means coding, at least one electronic means coding, at least one electro-conductive substrate means coding, at least one holographic means coding, at least one audible means singal coding means, at least one inaudible signal means coding, at least one mechanical coding means, at least one infra-red coding means and at least one olfactory coding means, wherein said readable coding information is read by at least one of before, during and after such marker members are adheringly applied to at least one certain publication vessel means and/or specific contents thereto.

19. The process of claim 16 wherein by at least one of before, during and after such machine readable marker means is adheringly applied to said publication vessel means coding for machine reading at least one surface exterior and/or implanting within the interior substrate of the marker member means to provide/generate information means, wherein optionally at least one implantion of said at least one machine code means is at least one of partially and entirely covered by at least one reference marker substrate means.

20. The process of claim 16 wherein by at least one of before, during and after such reference marker means is adheringly applied to said publication vessel means, optionally applying/attaching the protective thin and generally flexible covering means to at least one substrate of the reference marker, wherein said adhering reference marker is at least one element taken from the group consisting of at least one e adhesive layer means, at least one magnetic layer substrate means, and at least one statically adhering substrate means.

21. The process of claim 16 wherein said at least one machine reader is taken from the group consisting of at least one of scannable reader means, invisible information reader, magnetic information reader means, holographic information reader means, electronical information reader means, mechanical information reader means, electro-conductive substrate reader means, audible signal code reader means, inaudible signal code reader means and olfactory sensory reader means.

* * * * *